US007556541B2

(12) United States Patent
Tyler

(10) Patent No.: US 7,556,541 B2
(45) Date of Patent: Jul. 7, 2009

(54) ELECTRICAL TERMINAL WITH HIGH CONDUCTIVITY CORE

(75) Inventor: Adam P. Tyler, Rochester Hills, MI (US)

(73) Assignee: FCI Americas Technology, Inc., Carson City, NV (US)

( * ) Notice: Subject to any disclaimer, the term of this patent is extended or adjusted under 35 U.S.C. 154(b) by 116 days.

(21) Appl. No.: 11/888,795

(22) Filed: Aug. 2, 2007

(65) Prior Publication Data

US 2008/0146091 A1 Jun. 19, 2008

Related U.S. Application Data

(60) Provisional application No. 60/849,956, filed on Oct. 6, 2006.

(51) Int. Cl.
*H01R 13/187* (2006.01)

(52) U.S. Cl. ..... 439/843; 439/877

(58) Field of Classification Search ..... 439/843, 439/877–883

See application file for complete search history.

(56) References Cited

U.S. PATENT DOCUMENTS

| | | | | | |
|---|---|---|---|---|---|
| 2,788,508 | A | * | 4/1957 | Buchanan | 439/879 |
| 3,370,265 | A | | 2/1968 | Berg | |
| 3,568,137 | A | * | 3/1971 | Youngblut et al. | 439/865 |
| 3,654,594 | A | * | 4/1972 | Sitzler | 439/857 |
| 3,951,497 | A | | 4/1976 | Balzano et al. | 339/19 |
| 3,998,518 | A | * | 12/1976 | Mathe | 439/346 |
| 4,191,445 | A | | 3/1980 | Deal | 339/252 |
| 4,397,086 | A | | 8/1983 | Bickos et al. | 29/876 |
| 4,486,063 | A | * | 12/1984 | Seifert et al. | 439/442 |
| 4,648,673 | A | | 3/1987 | Endo et al. | 339/97 |
| 4,880,401 | A | | 11/1989 | Shima et al. | 439/746 |
| 5,035,655 | A | * | 7/1991 | Hesse | 439/699.2 |
| 5,226,842 | A | * | 7/1993 | Endo et al. | 439/843 |
| 5,271,741 | A | * | 12/1993 | Saito et al. | 439/843 |
| 5,348,498 | A | * | 9/1994 | Morello et al. | 439/877 |
| 5,441,428 | A | | 8/1995 | Hamai et al. | 439/843 |
| 5,951,314 | A | | 9/1999 | Durand-Cochet et al. | 439/252 |
| 5,951,336 | A | | 9/1999 | Seko et al. | 439/745 |
| 6,019,646 | A | | 2/2000 | Okamura et al. | 439/852 |
| 6,024,612 | A | | 2/2000 | Myer et al. | 439/852 |
| 6,062,918 | A | | 5/2000 | Myer et al. | 439/839 |
| 6,102,724 | A | | 8/2000 | Ring | 439/320 |
| 6,341,978 | B1 | * | 1/2002 | Akeda | 439/397 |
| 2002/0055297 | A1 | | 5/2002 | Feeny, Jr. | 439/453 |
| 2008/0139056 | A1 | * | 6/2008 | Kumakura | 439/866 |
| 2008/0146091 | A1 | * | 6/2008 | Tyler | 439/843 |

* cited by examiner

*Primary Examiner*—James Harvey
(74) *Attorney, Agent, or Firm*—Harrington & Smith, PC

(57) ABSTRACT

An electrical terminal including a first member and a second member. The first member has a front end configured to receive a mating contact and a rear end configured to attach to an electrical conductor. The first member is adapted to contact a first side of the mating contact. The second member is located, at least partially, in the first member. The second member is made from a material which is more conductive than material of the first member. The second member includes a front end configured to electrically contact an opposite second side of the mating contact and a rear end configured to attach to the electrical conductor.

21 Claims, 5 Drawing Sheets

ELECTRICAL TERMINAL WITH HIGH CONDUCTIVITY CORE

CROSS REFERENCE TO RELATED APPLICATION

This application claims priority under 35 U.S.C. §119(e) on U.S. provisional patent application No. 60/849,956 filed Oct. 6, 2006, which is hereby incorporated by reference in its entirety.

BACKGROUND OF THE INVENTION

1. Field of the Invention

The invention relates to an electrical terminal and, more particularly, to an electrical terminal with a high conductivity core.

2. Brief Description of Prior Developments

A problem exists with conventional electrical contact terminals in that there is a high and variable cost of material which is used to manufacture the terminals. A common material used in terminals is copper. Copper has a high and variable cost which can negatively impact the profitability of a manufacturer or seller of a traditional electrical terminal formed from copper alloys. There is a need to reduce the amount of copper used in a terminal to thereby reduce the effects of the high and variable cost of copper.

SUMMARY OF THE INVENTION

In accordance with one aspect of the invention, an electrical terminal is provided including a first member and a second member. The first member has a front end configured to receive a mating contact and a rear end configured to attach to an electrical conductor. The first member is adapted to contact a first side of the mating contact. The second member is located, at least partially, in the first member. The second member is made from a material which is more conductive than material of the first member. The second member includes a front end configured to electrically contact an opposite second side of the mating contact and a rear end configured to attach to the electrical conductor.

In accordance with another aspect of the invention, an electrical terminal is provided comprising a first member and a second member. The first member comprises a front end forming a cage for receiving a male contact, and a rear end having a conductor receiving area with tabs configured to be crimped onto a conductor. The second member is connected to the first member in a general nested position along a substantially entire length of the second member. The second member comprises a front end located in the cage and a rear end located in the conductor receiving area. The front end of the second member comprises a first contact area for contacting the male contact received in the cage and the rear end of the second member comprises a second contact area for contacting the conductor crimped against the second contact area by the tabs.

In accordance with another aspect of the invention, a method of assembling an electrical terminal is provided comprising providing a first member having a front end configured to receive a mating contact and a rear end configured to attach to an electrical conductor, wherein the first member is adapted to contact a first side of the mating contact; providing a second member having a front end configured to electrically contact an opposite second side of the mating contact and a rear end configured to attach to the electrical conductor; and inserting the second member into the first member, wherein the second member is located in a general nested position in the first member along a substantially entire length of the second member.

BRIEF DESCRIPTION OF THE DRAWINGS

The foregoing aspects and other features of the invention are explained in the following description, taken in connection with the accompanying drawings, wherein.

DETAILED DESCRIPTION OF THE PREFERRED EMBODIMENT

Figure 1:
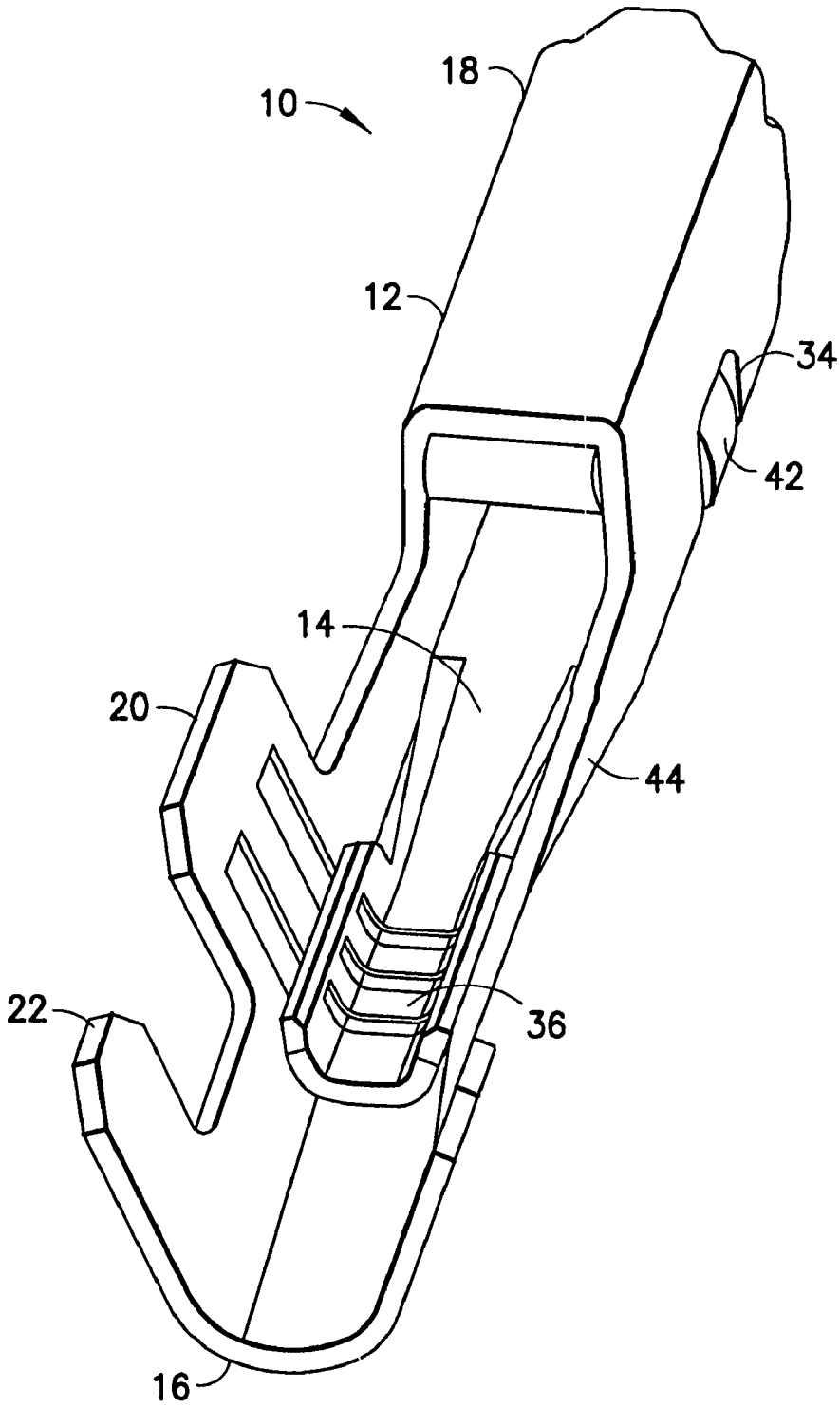
FIG. 1 is a perspective view of an electrical contact terminal comprising features of the invention.
Figure 2:
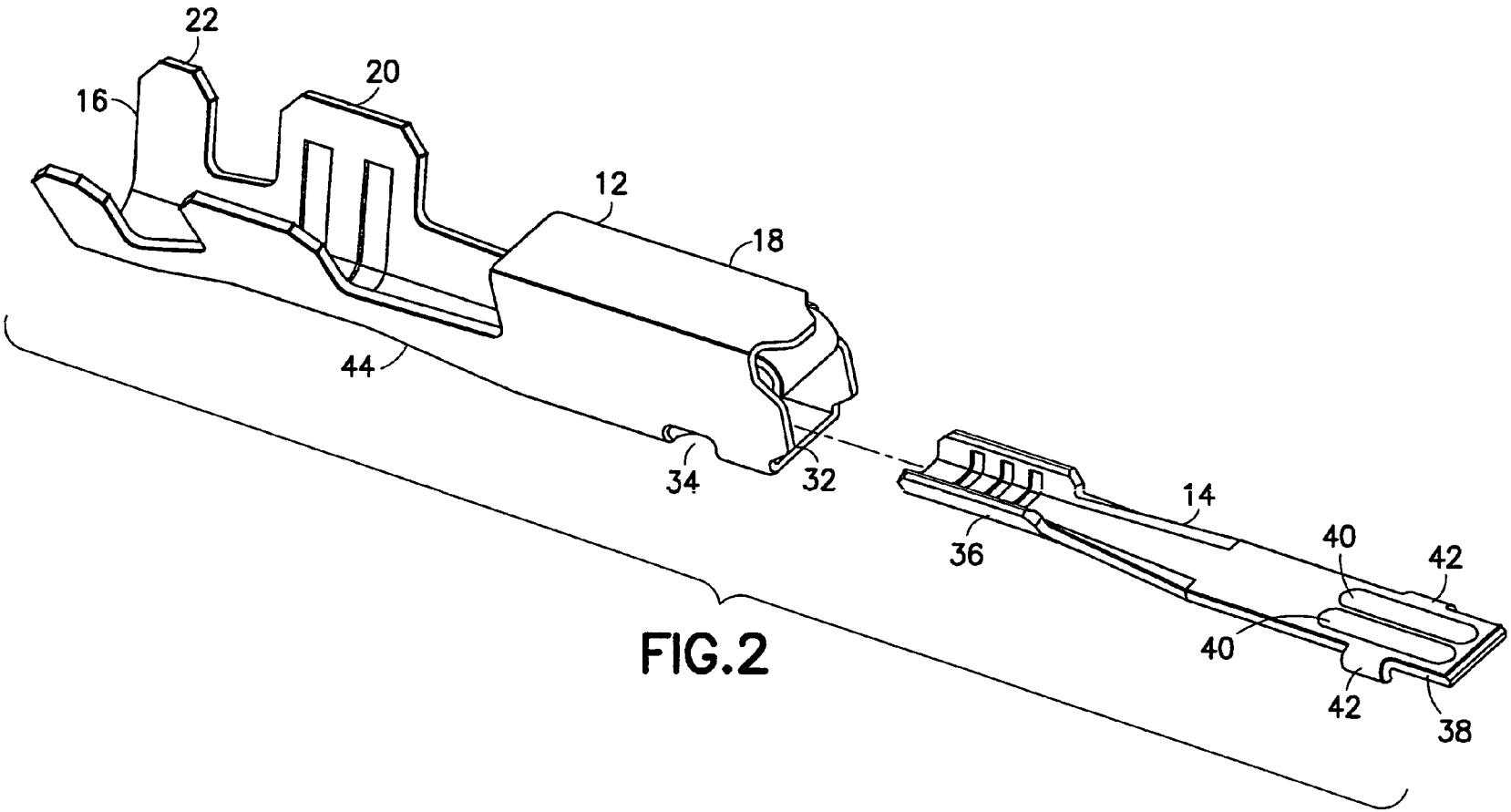
FIG. 2 is an exploded perspective view of the terminal shown in FIG. 1.
Figure 3:
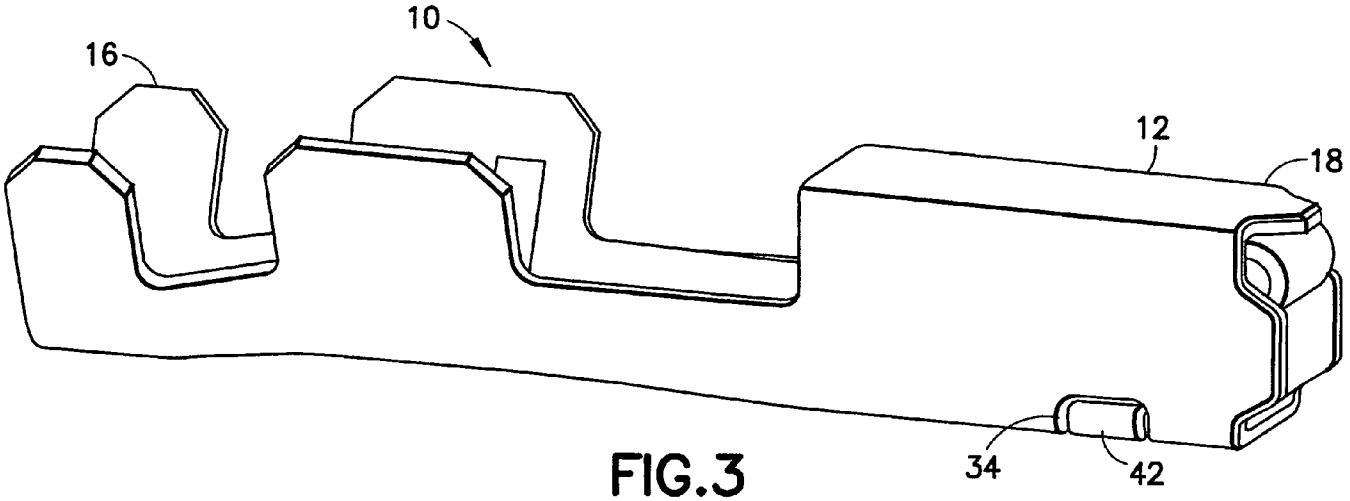
FIG. 3 is a perspective view of the terminal shown in FIG. 1 taken from another direction.
Figure 4:
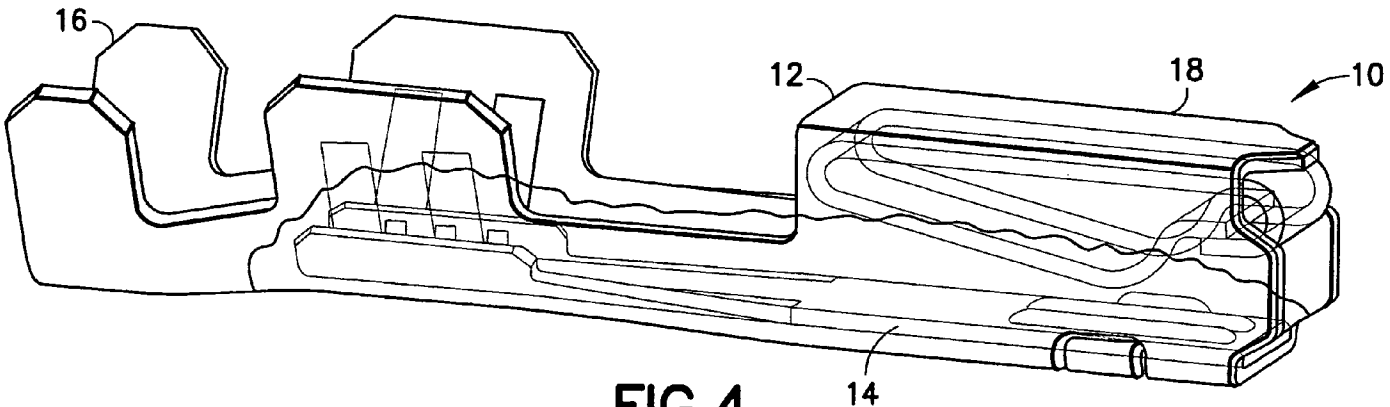
FIG. 4 is a perspective view of the terminal as in FIG. 3 with a cut-away section.
Figure 5:
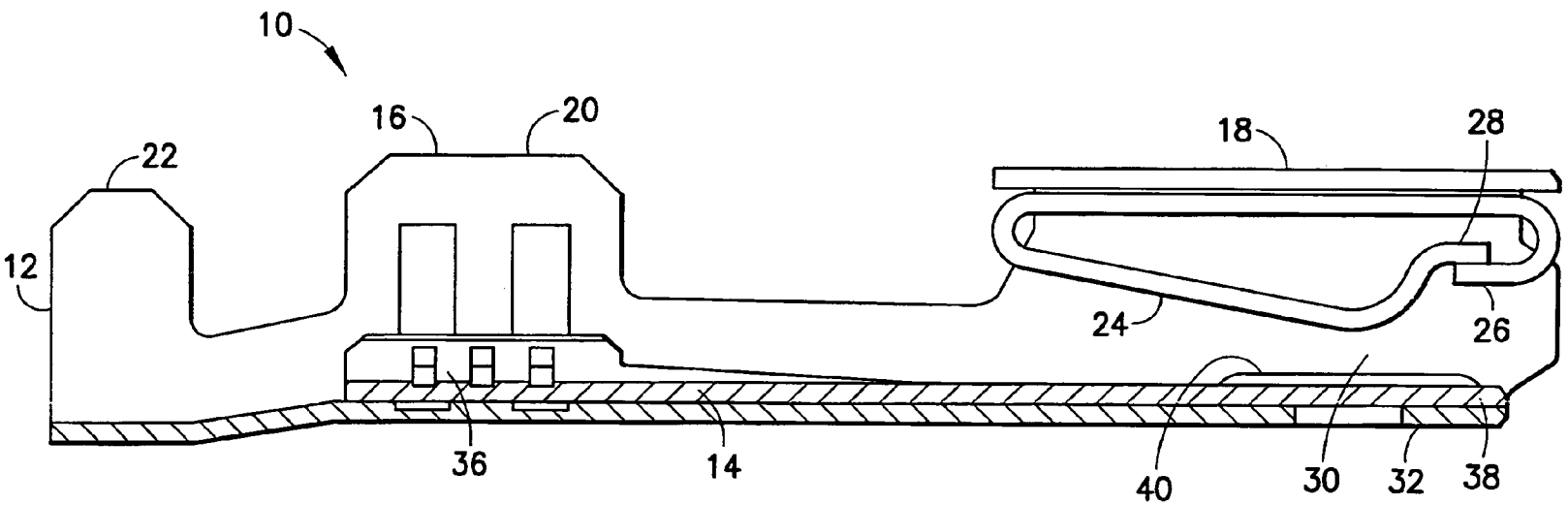
FIG. 5 is a cross sectional view of the terminal shown in FIGS. 1-4.

Referring to FIG. 1, there is shown a perspective view of an electrical contact or terminal 10 incorporating features of the invention. Although the invention will be described with reference to the exemplary embodiment shown in the drawings, it should be understood that the invention can be embodied in many alternate forms of embodiments. In addition, any suitable size, shape or type of elements or materials could be used. The terminal 10 is preferably used in an electrical connector with the terminal mounted in a housing of the electrical connector.

The terminal 10 generally comprises a terminal body 12 and a high conductivity core 14. In alternate embodiments the terminal could comprise more than two members. The body 12 can be comprised of any suitable material, such as stainless steel or plastic for example. Preferably, the body 12 is made of a material which is relatively less expensive and/or less volatile in cost than the material used to make the core 14. Referring also to FIGS. 2-5, the core 14 is connected to the body 12 in a general nested position as shown.

In the embodiment shown the body 12 is comprised of a one-piece member made of metal, such as stainless steel, which has been stamped and formed. However, the body could be comprised of multiple members. The body 12 generally comprises a first connection section 16 at a rear end of the body and a second connection section 18 at a front end of the body. The first connection section 16 generally comprises a conductor receiving channel having first tabs 20 adapted to be crimped onto a conductive core of an electrical wire (not shown) and second tabs 22 adapted to be crimped onto electrical insulation of the wire. However, in alternate embodiments, any suitable type of first connection section 16 could be provided.

The second connection section 18 generally forms a female cage for removably receiving a mating male contact or pin (not shown) of a mating electrical connector (not shown). The cage is preferably formed by folding the material of the body 12 into the shape shown, but any suitable shape could be provided. As seen best in FIG. 5, in this embodiment the second connection section 18 includes a contact arm 24 and a contact arm restraint 26. The contact arm 24 extends forward and downward from the top rear of the cage. The contact arm restraint 26 extends rearward and downward from the top front of the cage. The front end 28 of the arm 24 is restrained on top of the restraint 26 to limit its downward movement into the male contact receiving area 30. The arm 24 is adapted to bias the male contact (not shown) in a direction towards the bottom side 32 of the cage. However, in alternate embodiments any suitable system or configuration for urging the male contact into contact with the core 14 could be provided. The cage includes two mounting holes 34 at corners of its bottom side and its lateral sides.

The core 14 is preferably comprised of a material which has a higher conductivity than the body 12, such as a copper alloy for example. The core 14 is preferably a one-piece member which has been stamped and formed. The core 14 generally comprises a rear end 36 which forms a first conductor contact section and a front end 38 which forms a second conductor contact section. When the core 14 is mounted to the body 12 the rear end 36 is located at the first connection section 16 of the body and the front end 38 is located at the second connection section 18 of the body. The rear end 36 generally comprises a channel shape which is adapted to receive the conductor core of the wire (not shown) therein. The channel shape is adapted to nest on the body 12 at the base of the tabs 20. Thus, when the tabs 20 are crimped onto the conductor core of the wire, the tabs 20 crimp the conductor core of the wire against the core 14 in the channel formed at its rear end 36. The rear end 36 is preferably serrated to make contact with stands of the wire's conductor core. The tabs 20, 22 form grips which mechanically join the wire to the terminal.

The front end 38 of the core 14 generally comprises contact rails 40 and mounting tabs 42. The rails 40 comprise stamped protrusions which extend upward. The rails 40 create a stable electrical contact with the male contact when the male contact is inserted into the receiving area 30. When the male contact is inserted into the receiving area 30, the arm 24 pushes the male contact against the top sides of the rails 40. The shape of the rails 40 also concentrate area of contact with the male contact for a better wiping contact. The tabs 42 are inserted into the mounting holes 34 of the body 12 and deformed to fixedly attach the core 14 to the body; similar to a stapled type of connection. By locating the core 14 in the cage, at the trough between the tabs 20, and inside the trough of the transition zone 44 between the two connection sections 16, 18 of the body 12, the terminal body retains and protects the core 14, as well as providing a locking surface. In alternate embodiments, any suitable type of connection of the core 14 to the body 12 could be provided.

Figure 6:
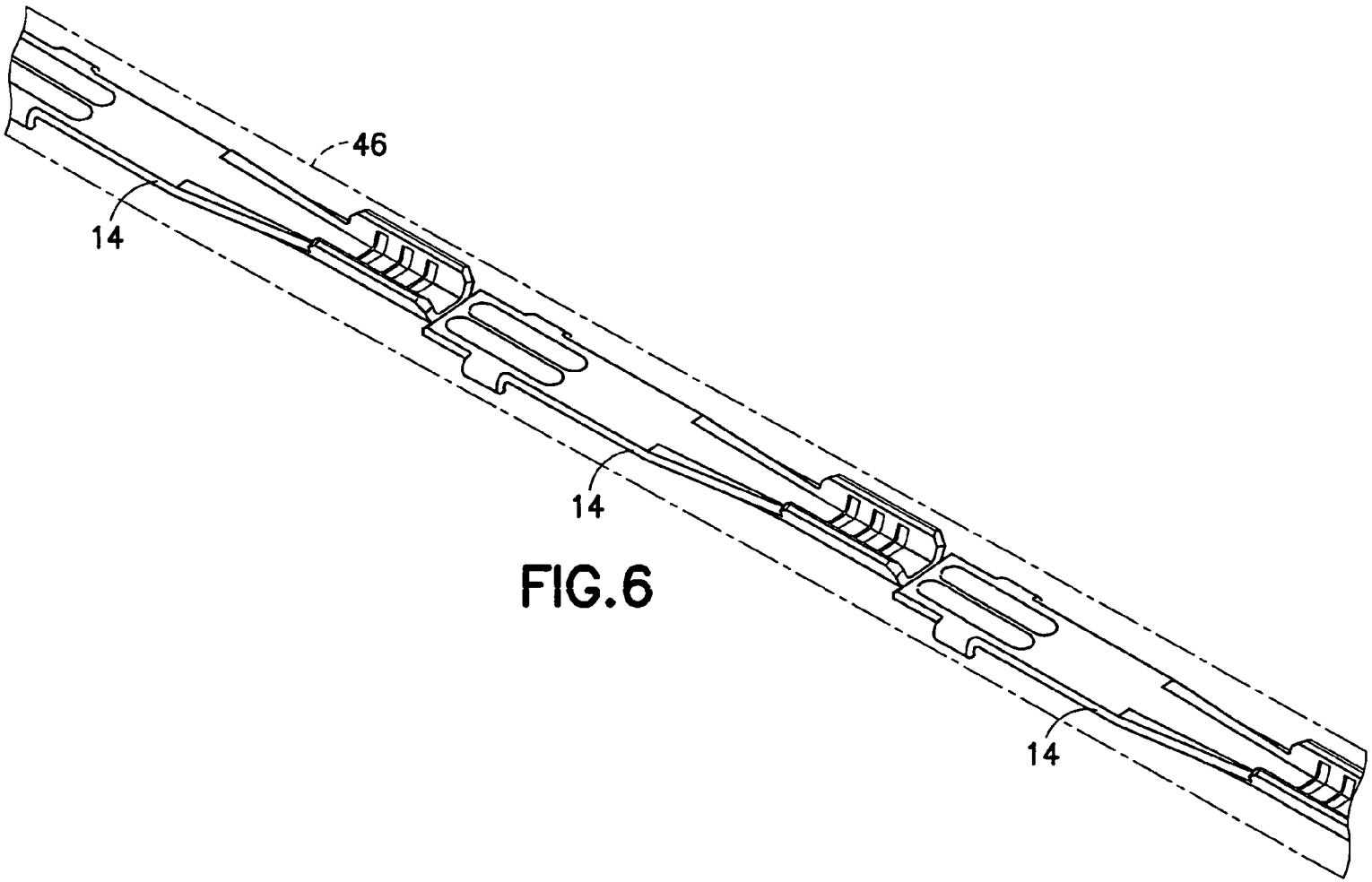
FIG. 6 is a perspective view showing one method for manufacturing the core of the terminal shown in FIGS. 1-5.

Referring also to FIG. 6, in one exemplary type of method of manufacturing the core 14, the core 14 is stamped and formed from an elongate strip 46 of material as a series of cores which are subsequently separated from each other. As can be seen, in this method the cores are fabricated with their longitudinal lengths aligned with the longitudinal length of the strip. The cores 14 are joined front to rear with adjacent cores. Very little scrap material from the strip 46 is generated because of the generally elongate strip-like shape of the final shape of the cores 14. Because very little scrap material is generated, almost all of the strip 64 is used to form the cores 14 and, thus, the cores 14 are not as expensive to manufacture than if more of the material ended up as scrap material. In an alternate method, any suitable method for manufacturing the high conductivity core 14 could be provided.

As noted above, a problem exists with conventional electrical contact terminals in that there is a high and variable cost of material which is used to manufacture the terminals. A common material is copper used in terminals. Copper has a high and variable cost which can negatively impact the profitability of a manufacturer or seller of a traditional electrical terminal formed from copper alloys. There is a need to reduce the amount of copper used in a terminal to thereby reduce the effects of the high and variable cost of copper. A solution can comprise greatly reducing the amount of copper, and copper scrap in a terminal by limiting its use to an uninterrupted, direct path from the contact to the crimp. Use a low-cost, low-conductivity, high-strength alloy (such as Stainless steel for example) to form the body of the terminal and its spring can be used.

An electrical terminal with a high conductivity core can provide numerous advantages. The copper core does not require a carrier strip, and very little material is removed from the edges, so scrap is minimized. Because the copper core does not have any mechanical strength requirements, a very high conductivity and low cost alloy can be used. The high conductivity copper core material thickness can be varied independently of the body material to accommodate the total system conduction needs. The plating on the high conductivity copper core 14 (i.e. tin, gold, silver, etc.) can be changed without changing the material of the terminal body 12.

With the invention, an electrical terminal can be provided with a first member having a front end configured to receive a mating contact and a rear end configured to attach to an electrical conductor, wherein the first member is adapted to contact a first side of the mating contact; and a second member located, at least partially, in the first member, wherein the second member comprises a material which is more conductive than material of the first member, and wherein the second member comprises a front end configured to electrically contact an opposite second side of the mating contact and a rear end configured to attach to the electrical conductor.

The front end of the first member can comprise a cage, and the rear end of the first member can comprise crimp tabs. The front end of the first member can comprise a spring to bias the mating contact in a direction towards the front end of the second member. The second member is preferably substantially straight with a conductor receiving channel at the rear end of the second member. The second member can comprise a top side contact rail and lateral side mounting tabs on the front end of the second member. The second member has a bottom side which is preferably located substantially entirely against a surface of the first member.

The invention can provide an electrical terminal comprising a first member comprising a front end forming a cage for receiving a male contact, and a rear end having a conductor receiving area with tabs configured to be crimped onto a conductor; and a second member connected to the first member in a general nested position along a substantially entire length of the second member, wherein the second member comprises a front end located in the cage and a rear end located in the conductor receiving area, wherein the front end of the second member comprises a first contact area for contacting the male contact received in the cage and the rear end of the second member comprises a second contact area for contacting the conductor crimped against the second contact area by the tabs.

It should be understood that the foregoing description is only illustrative of the invention. Various alternatives and modifications can be devised by those skilled in the art without departing from the invention. Accordingly, the invention is intended to embrace all such alternatives, modifications and variances which fall within the scope of the appended claims.

What is claimed is:

1. An electrical terminal comprising:

a first member having a front end configured to receive a mating contact and a rear end configured to attach to an electrical conductor, wherein the first member is adapted to contact a first side of the mating contact; and a second member located, at least partially, in the first member, wherein the second member comprises a material which is more conductive than material of the first member, and wherein the second member comprises a front end configured to electrically contact an opposite second side of the mating contact and a rear end configured to attach to the electrical conductor, wherein the second member has a bottom side located substantially entirely against a surface of the first member.

2. An electrical terminal as in claim 1 wherein the front end of the first member comprises a cage.

3. An electrical terminal as in claim 1 wherein the rear end of the first member comprises crimp tabs.

4. An electrical terminal as in claim 1 wherein the front end of the first member comprises a spring to bias the mating contact in a direction towards the front end of the second member.

5. An electrical terminal as in claim 1 wherein the second member is substantially straight with a conductor receiving channel at the rear end of the second member.

6. An electrical terminal comprising:

a first member having a front end configured to receive a mating contact and a rear end configured to attach to an electrical conductor, wherein the first member is adapted to contact a first side of the mating contact; and a second member located, at least partially, in the first member, wherein the second member comprises a material which is more conductive than material of the first member, and wherein the second member comprises a front end configured to electrically contact an opposite second side of the mating contact and a rear end configured to attach to the electrical conductor, wherein the second member is substantially straight with a top side contact rail and lateral side mounting tabs on the front end of the second member.

7. An electrical terminal as in claim 1 wherein the second member is substantially straight.

8. An electrical terminal as in claim 1 wherein the first member is comprised of stainless steel and the second member is comprised of copper.

9. An electrical terminal as in claim 1 wherein the front end of the first member comprises a cage, and wherein the rear end of the first member comprises crimp tabs.

10. An electrical terminal as in claim 9 wherein the front end of the first member comprises a spring to bias the mating contact in a direction towards the front end of the second member.

11. An electrical terminal as in claim 10 wherein the second member is substantially straight with a conductor receiving channel at the rear end of the second member.

12. An electrical terminal as in claim 11 wherein the second member comprises a top side contact rail and lateral side mounting tabs on the front end of the second member.

13. A method of assembling an electrical terminal comprising:

providing a first member having a front end configured to receive a mating contact and a rear end configured to attach to an electrical conductor, wherein the first member is adapted to contact a first side of the mating contact;

providing a second member having a front end configured to electrically contact an opposite second side of the mating contact and a rear end configured to attach to the electrical conductor; and inserting the second member into the first member, wherein the second member is located in a general nested position in the first member along a substantially entire length of the second member.

14. An electrical terminal as in claim 12 wherein the second member comprises copper.

15. An electrical terminal comprising:

a first member comprising a front end forming a cage for receiving a male contact, and a rear end having a conductor receiving area with tabs configured to be crimped onto a conductor; and a second member connected to the first member in a general nested position along a substantially entire length of the second member, wherein the second member comprises a front end located in the cage and a rear end located in the conductor receiving area, wherein the front end of the second member comprises a first contact area for contacting the male contact received in the cage and the rear end of the second member comprises a second contact area for contacting the conductor crimped against the second contact area by the tabs.

16. An electrical terminal as in claim 15 wherein the front end of the first member comprises a spring to bias the male contact in a direction towards the front end of the second member.

17. An electrical terminal as in claim 15 wherein the second member is substantially straight and wherein the first contact area comprises a conductor receiving channel at the rear end of the second member.

18. An electrical terminal as in claim 15 wherein the second member is substantially straight with a top side contact rail and lateral side mounting tabs on the front end of the second member.

19. An electrical terminal as in claim 15 wherein the second member is substantially straight and has a bottom side located substantially entirely against a surface of the first member.

20. An electrical terminal as in claim 15 wherein the first and second members are comprised of different materials having different electrical conductivity.

21. A method as in claim 13 wherein providing the second member comprises forming the second member from a flat stock material in a front end to rear end series with other second members in a strip, wherein the second member is substantially straight.

* * * * *